US008733728B2

(12) United States Patent
Reilly

(10) Patent No.: US 8,733,728 B2
(45) Date of Patent: May 27, 2014

(54) FORMWORK CLAMP

(75) Inventor: Matthew Kent Reilly, Aitkenvale (AU)

(73) Assignee: Hal Brackets Pty Ltd., Aitkenvale, QLD (AU)

( * ) Notice: Subject to any disclaimer, the term of this patent is extended or adjusted under 35 U.S.C. 154(b) by 24 days.

(21) Appl. No.: 12/733,655

(22) PCT Filed: Sep. 11, 2008

(86) PCT No.: PCT/AU2008/001355

§ 371 (c)(1),
(2), (4) Date: Jul. 16, 2010

(87) PCT Pub. No.: WO2009/033225

PCT Pub. Date: Mar. 19, 2009

(65) Prior Publication Data

US 2010/0293887 A1 Nov. 25, 2010

(30) Foreign Application Priority Data

Sep. 13, 2007 (AU) ..... 2007216794

(51) Int. Cl.
*E04G 17/00* (2006.01)

(52) U.S. Cl.
USPC ..... 249/219.1

(58) Field of Classification Search
USPC ..... 249/27, 192, 219.2, 26, 33, 34, 44, 93, 249/219.1; 52/745.12, 127.2
See application file for complete search history.

(56) References Cited

U.S. PATENT DOCUMENTS 1,700,798 A * 2/1929 Heltzel ..... 249/6
2,163,808 A * 6/1939 Pithoud ..... 52/105
2,510,717 A * 6/1950 Roos ..... 269/46
2,511,584 A 6/1950 Hill
2,741,821 A * 4/1956 Findley ..... 249/189
3,006,592 A * 10/1961 Davis, Jr. ..... 248/354.3
3,428,287 A * 2/1969 Redding et al. ..... 249/13
3,574,981 A * 4/1971 Henschen ..... 52/127.2
3,785,606 A * 1/1974 Green ..... 249/3
3,817,006 A * 6/1974 Williams ..... 52/127.2
5,076,536 A * 12/1991 Fitzgerald ..... 249/219.1
5,174,083 A * 12/1992 Mussell ..... 52/169.1
6,065,254 A 5/2000 Lanka
6,539,677 B1 * 4/2003 Lanka ..... 52/127.2
2006/0201743 A1 9/2006 Dell'Erba et al.
2006/0207215 A1 9/2006 Bruno
2007/0175174 A1 8/2007 Bruno

* cited by examiner

*Primary Examiner* — Darnell Jayne
*Assistant Examiner* — Timothy M Ayres
(74) *Attorney, Agent, or Firm* — Stein IP, LLC

(57) ABSTRACT

A formwork clamp comprising: a lower elongate support member having a head portion and a tail portion, the head portion adapted for attachment to a lower portion of formwork, an upper elongate support member having a head portion and a tail portion, the lower elongate support member and the upper elongate support member being attached relative to each other and movable relative to each other between a collapsed position where the lower elongate member is more towards or against the upper elongate member, and an extended use position where the head portion of the upper elongate member is spaced away from the lower elongate member, a mounting member attached to or forming part of the head portion of the upper elongate support member, the mounting member being attachable to an upper portion of the formwork, the upper elongate support member being adjustable in length, and anchor means to enable the formwork clamp to be anchored to the ground.

10 Claims, 5 Drawing Sheets

STEP 2

STEP 3

FORMWORK CLAMP

FIELD OF THE INVENTION

This invention is directed to a clamp and particularly a versatile length adjustable clamp for use in concrete formwork.

BACKGROUND ART

An example of concrete formwork is the formwork that is used for a concrete slab and typically a concrete house slab. The formwork comprises lengths of timber panels (although some times aluminium formwork is used). The formwork defines the perimeter of the slab and concrete is poured into the area defined by the formwork. After the concrete is at least partially set, the formwork is removed.

It is necessary to make sure that the formwork does not move while the slab is being poured. It is also necessary to make sure that the formwork does not move by being accidentally kicked or stepped on by a worker.

For this reason, it is well-known to provide various props or anchors to hold the formwork in place during the concrete pour and while the concrete is curing. A popular type of prop comprises lengths of wood which are cut to length and wedged on the outside of the formwork to hold the formwork in place. This is however fiddly and time consuming. Moreover, these props are not very effective and it is known for the formwork to move under the weight of the concrete (typically to move outwardly). If a prop is accidentally kicked it is quite easily dislodged.

It is important that the formwork is positioned exactly vertical so that the edge of the slab is also exactly vertical and remains straight. Thus, the formwork must not bow under the weight of the concrete pressing against the side of the formwork. The formwork must also not tilt or tip during the concrete pour or under the weight of the concrete bearing against the formwork. String lines are used to ensure that the formwork stays exactly straight and does not bow as the concrete bears against the formwork during the concrete pour. If there is any bowing, the props need to be repositioned to compensate. Similarly, if the formwork begins to tip or tilt out of vertical, the props need to be repositioned or additional props need to be placed to compensate.

Some of the disadvantages with existing formwork props etc include the following:

- the props are not easy to use.
- the props are not sturdy and strong and are difficult if not impossible to adjust.
- the props take a long time to set up and take down.
- the props do not last very long.
- the props are quickly covered in concrete which is difficult to remove and makes the props difficult to reuse.
- the props are difficult to firmly anchor into the ground to provide a good propping action.
- the props require larger number of pegs to anchor the props into the ground.
- the props are not easily transported and stored.

Therefore, there would be a distinct advantage if it were possible to provide a formwork clamp which could be used to temporarily prop formwork during a concrete pour and which is relatively easy to use and reliable in action and which can compensate for any movement (e.g. bowing/tilting) of the formwork during the concrete pour.

It will be clearly understood that, if a prior art publication is referred to herein, this reference does not constitute an admission that the publication forms part of the common general knowledge in the art in Australia or in any other country.

OBJECT OF THE INVENTION

It is an object of the invention to provide a concrete formwork clamp which may overcome at least some of the above-mentioned disadvantages or provide a useful or commercial choice.

In one form the invention resides in a formwork clamp comprising:

1. A lower elongate support member having a head portion and a tail portion, the head portion adapted for attachment to a lower portion of formwork,
2. An upper elongate support member having a head portion and a tail portion,
3. The lower elongate support member and the upper elongate support member being attached relative to each other and movable relative to each other between a collapsed position where the lower elongate member is more towards or against the upper elongate member, and an extended use position where the head portion of the upper elongate member is spaced away from the lower elongate member,
4. A mounting member attached to or forming part of the head portion of the upper elongate support member, the mounting member being attachable to an upper portion of the formwork,
5. The upper elongate support member being adjustable in length, and
6. Anchor means to enable the formwork clamp to be anchored to the ground.

The term "ground" is meant to include the area on which the formwork is positioned. For a house slab, the formwork is positioned on the soil. However, the formwork may also be used to support a concrete pour in an elevated position (e.g. a multi-storey building) and the term "ground" is meant to include the area adjacent the formwork.

The formwork clamp has many advantages including ease of use and the ability to quickly and accurately compensate for any bowing or movement of the formwork during the concrete pour.

It is envisaged that one popular use of the formwork clamp will be to support concrete formwork used in the pouring of a house slab but it is not envisaged that the invention should be limited only to this use of the formwork clamp.

The lower elongate support member may comprise an elongate arm member. The arm member may have a length of between 50-150 cm although this may vary depending on the type of formwork. The arm member is suitably made of strong rugged reusable and robust material and therefore it is envisaged that the member will be made of metal such as steel. Of course, the member may be made of other suitable material is such as aluminium, strong reinforced plastics and the like.

As an example of the invention, the arm member may comprise box steel which is square or rectangle in cross-section and which may have a width of 10-50 mm and a similar depth. The thickness of the steel will typically be between 1-4 mm. The arm member may be protected against corrosion by any suitable means which may include galvanising, painting, anodising and the like.

There may be circumstances where it is advantageous for the lower elongate support member to be other than a length of steel box section. For instance, the lower elongate support member may comprise a relatively flat plate member. Alternatively, the lower elongate support member may comprise an arm member as described above which may be attached (e.g. by welding) to a lower plate member.

The lower elongate support member has a head portion and a tail portion. The head portion is meant to include the part of the elongate support member which is nearest to the formwork and the tail portion is meant to include the part of the elongate support member which is the way from the formwork.

The head portion of the lower elongate support member is adapted for attachment to the formwork and typically to a lower part of the formwork. The size and shape of the head portion may vary to suit the attachment. The head portion may be formed separately and attached to the elongate support member by any suitable means and it is preferred that the head portion is permanently fixed to the elongate support member (to reduce the number of separate parts of the entire clamp) and therefore it is preferred that the head portion is welded or otherwise fixed to the elongate support member.

The head portion may comprise an attachment bracket having a size and a shape to enable it to be fastened to the formwork. As an example, the attachment bracket may comprise a rectangular plate welded or otherwise attached to the elongate support member. The plate may be provided with at least one opening through which a fastener (e.g. a self drilling screw) can pass to temporarily fix the lower elongate support member to the formwork. As another example, the fastener may comprise a nail, a staple and the like. It is also envisaged that the formwork may be provided with some form of configuration (for instance an opening or slot) into which the attachment bracket or the head portion of the lower elongate member can pass to hold the lower elongate member in place. Alternatively, the formwork may be provided with a projection of some suitable configuration which can pass through an opening or recess on the lower elongate support member to temporarily hold the lower elongate support member to the formwork.

The lower elongate support member may have some form of means to enable the length of the support member to be adjusted, inter alia, to compensate for any movement of the formwork. The adjustment means may be the same or similar to the length adjustment means on the upper elongate support member which will be described below.

The upper elongate support member may be somewhat similar to that described above with reference to the lower elongate support member and therefore may comprise an upper arm member having features similar to that described above.

The upper elongate support member may be attached relative to the lower elongate support member for movement between a collapsed position and a use position. This allows easier transportation and storage by enabling the formwork clamp to be collapsed into a relatively compact form when not required.

Preferably, the upper elongate support member and the lower elongate support member are hinged to each other or relative to each other for pivoting movement between the collapsed position and the use position. In the collapsed position, it is envisaged that the two members will be against each other and therefore in a relatively compact form. In the use position, the two members will define an angle between them and it is envisaged that in the use position, the two members will be substantially V shaped relative to each other, and therefore defining an angle of between 30-70°. This can of course vary to suit.

It is envisaged that the lower and upper elongate members will be pinned or hinged to each other at the tail portion of each elongate member. Thus, one elongate member may be provided with a small bracket to accommodate a pivot pin which can extend through the other elongate member, Alternatively the two members can be pinned directly to each other.

The upper elongate member contains a mounting member which is adapted for attachment to an upper portion of the formwork and typically vertically above the position where the lower elongate member is attached to a lower portion of the formwork. The mounting member will typically have a configuration to enable it to be quickly attached to the formwork. Thus, the mounting member may contain a plate like portion containing an opening through which a fastener (for instance a self drilling screw) can pass to temporarily attach the mounting member (and therefore the upper elongate member) to the formwork. Alternatively, the attachment may be by other means including the variations described above with reference to the lower elongate support member.

Suitably, the mounting member will have a substantially L-shaped plate like portion which can extend over part of the top and part of the side of the formwork. The size of the plate like portion may vary as may the shape, but in an example, the plate like portion may be somewhat rectangular and may have a length of between 2-10 cm and a similar width and may have a thickness of between 2-5 mm.

The upper elongate member is adjustable in length. This enables the formwork clamp to accommodate or compensate for changes in the formwork (e.g. bowing). It also enables the formwork to be kept substantially vertical such that the edge of the concrete slab is also vertical.

In one form, the upper elongate member can be telescopic and therefore adjustable in length. In this form of the invention, the upper elongate member may comprise a hollow housing, and a rod which can extend from the housing (to lengthen the elongate member), or retract into the housing (to shorten the elongate member). One way in which this can be achieved is to provide some form of threading engagement between the housing and the rod. For instance, the rod may have a threaded portion along the appropriate part of the rod or the rod may be entirely threaded along its length. The housing may have a corresponding threaded portion inside the housing or alternatively a threaded portion may be provided on the front of the housing. Rotation of the rod can then cause the upper elongate member to be adjusted in length whilst preventing "telescopic collapse" of the elongate member because of the threading engagement between the rod and the respective portion on/in the housing.

To provide maximum length adjustability, it is preferred that the rod is threaded substantially along its length. The rod may comprise a steel solid threaded rod which may have a length of between 20-100 cm and a diameter of between 5-25 mm. The housing may comprise a cylindrical housing or "box section" housing. In a simple form of the invention, a nut can be welded or otherwise attached to the open front of the housing to provide the threading engagement with the rod.

It is preferred that the housing does not rotate and the rod rotates to cause extension or retraction.

As the rod may be quite difficult to grip and turn, a turn member may be provided to assist in rotation of the rod. The turn member may be fastened to the rod and may provide a larger gripping area to make it easier to rotate the rod. It is preferred that the turn member is welded or otherwise fixed to the rod in such a manner that the turn member does not move relative to the rod. The turn member may be provided with a configuration to make it even easier to rotate the rod by enabling a tool to engage with the turn member to rotate to turn member. One simple manner in which this can be achieved is to provide an L-shaped lug extending outwardly from the turn member which can engage with a hand-held rod or a claw hammer or something similar to provide a lever action thereby enabling the rod to be rotated more easily. Alternatively, the turn member may be provided with a socket or something similar in which a rod can be inserted to again provide a lever action. Other types of extensions or configurations may be used. For instance, the turn member may be provided with one or more radially extending wings that can be more easily gripped to rotate the turn member. In another variation, the turn member may be angular in cross-section to enable a spanner to extend about the turn member to rotate it.

It is preferred that the turn member is positioned adjacent the outer end of the rod.

Other types of length adjusting means may be provided. For instance, instead of a threaded rod, the upper arm member may comprise a rear part and a front part with the front part being attachable to the rear part at various different positions to provide length adjustability. This can be achieved using a pin in slot arrangement. For instance, one of the parts may be provided with a pin and the other of the parts may be provided with an array of openings or slots in which the pin can be positioned.

A ratchet mechanism may also be provided although this may be more susceptible to fouling by dirt or concrete unless it is well protected.

The upper arm member contains a mounting member as described above. If the length adjustability comprises a rotating rod, the mounting member may be attached to the rotating rod in such a manner that rotation of the rod does not cause rotation of the mounting member. Put differently, the mounting member and the rod may be relatively rotatable to each other. This can be achieved in a number of ways. In one way, the mounting member may be provided with an opening through which the threaded rod can pass the opening being of a size to not engage with a threaded rod which means that rotation of the threaded rod does not rotate the mounting member.

A second end portion (which may include a washer) can then be attached to the end of the threaded rod to rotatably "trap" the mounting member to the threaded rod. The preferred embodiment described below illustrates this option.

Some form of anchor means is provided to enable the formwork clamp to be held on to the ground in such a manner that it will not slide during the concrete pour. In one form it is envisaged that part of the formwork clamp can be pinned to the ground using a stake, and an anchor pin or something similar (usually a steel pin that can be hammered in the ground). It is preferred that a rear part of the formwork clamp can be pinned or otherwise anchored to the ground. Thus, a rear portion of the formwork clamp can contain a foot plate having an opening through which an anchor pin can be hammered to hold the formwork clamp in position on the ground. The size and shape of the foot plate can vary but it is envisaged that the foot plate will be somewhat rectangular when viewed in plan and may have a length of between 20-100 mm and a similar width. The foot plate is preferably permanently fixed to the remainder of the formwork clamp and one way in which this can be achieved is by welding the foot plate to the lower member of the formwork clamp.

If an opening is not used, it is envisaged that the anchor pin may have a head portion that clamps against the foot plate to hold the formwork clamp in place. Other configurations may also be used.

It is preferred that the anchor pin (and therefore the opening in the foot plate) is positioned immediately behind the pivot point between the upper arm member and the lower arm member as this is where most of the forces acting on the formwork clamp will combine and there is an advantage in having the anchor pin in this area.

The distance between the front part of the lower elongate support member and a front part of the upper elongate support member can vary from almost 0 (a collapsed position) up to 1 m. A preferred maximum spacing would be between 20-60 cm. Very large formwork clamps may have a spacing of greater than 1 m.

BRIEF DESCRIPTION OF THE DRAWINGS

An embodiment of the invention will be described with reference to the following drawings in which:.

BEST MODE

Figure 1:
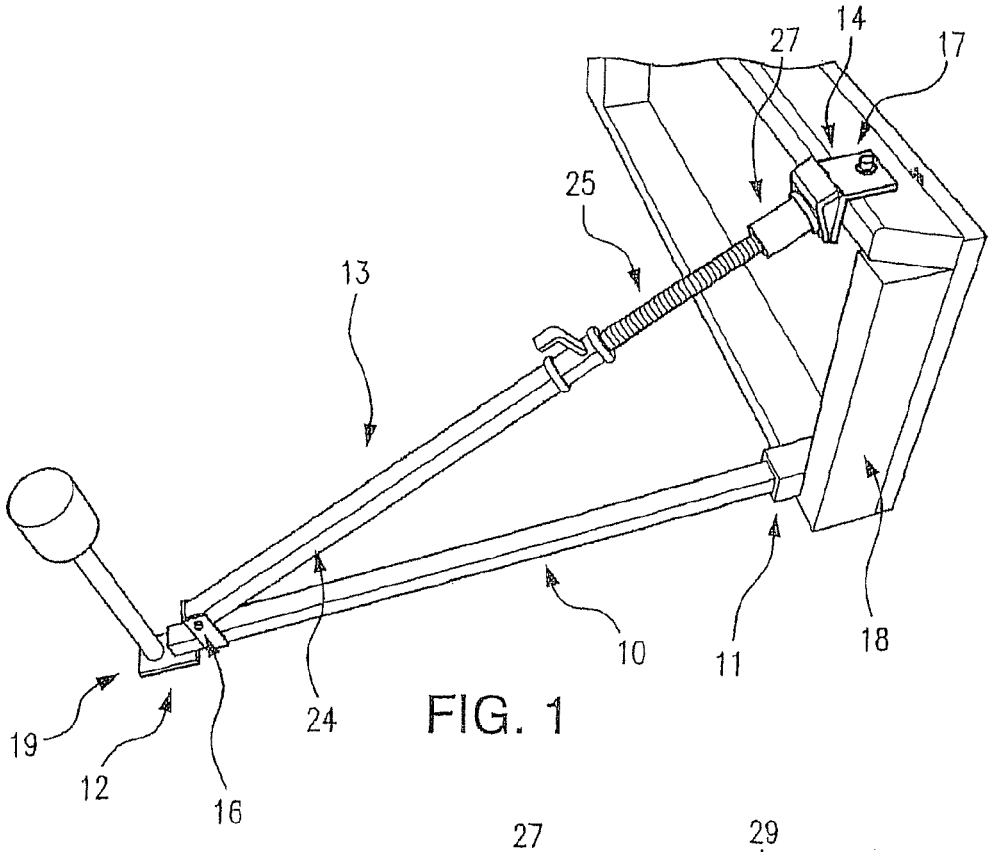
FIG. 1. Illustrates a formwork clamp in the use position.
Figure 3:
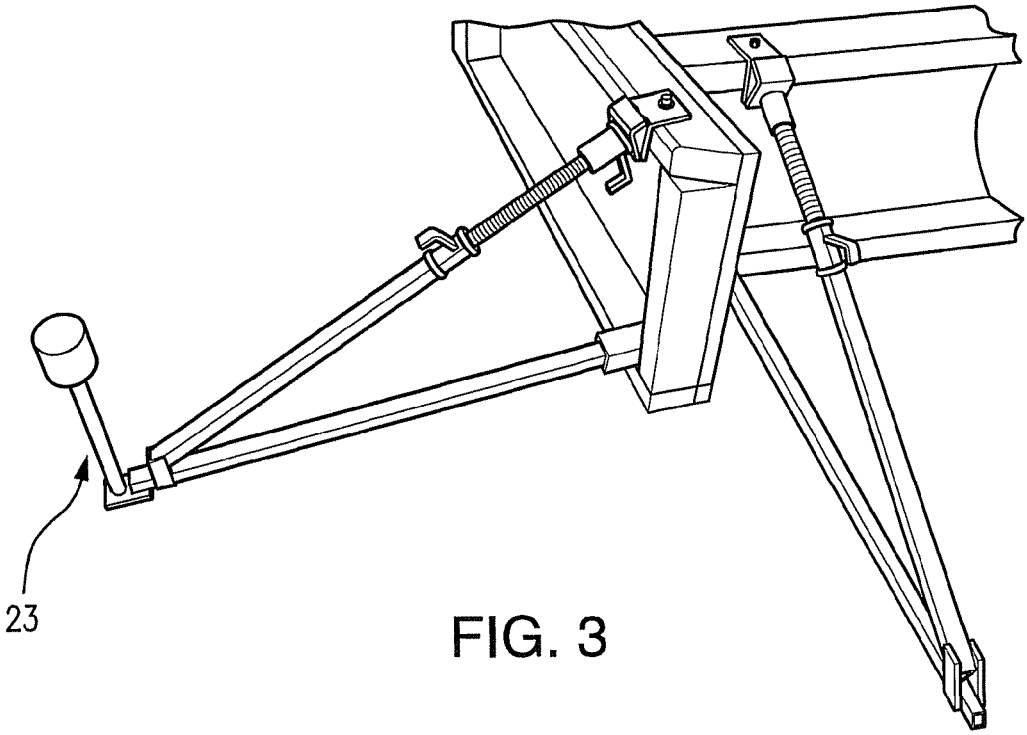
FIG. 3. Illustrates the formwork clamp of FIG. 1 but now also illustrating an adjacent formwork clamp.

Referring to the illustrations there is described a formwork clamp comprising the following general features:

1. A lower elongate support member 10 having a head portion 11 and a tail portion 12, the head portion adapted for attachment to a lower portion of formwork 18,
2. An upper elongate support member 13 having a head portion 14 and a tail portion 15,
3. The lower elongate support member and the upper elongate support member being attached relative to each other 16 and movable relative to each other between a collapsed position where the lower elongate member is more towards or against the upper elongate member, and an extended use position (see for instance FIG. 1 and FIG. 3) where the head portion of the upper elongate member is spaced away from the lower elongate member,
4. A mounting member 17 attached to or forming part of the head portion of the upper elongate support member 13, the mounting member being attachable to an upper portion of the formwork 18,
5. The upper elongate support member being adjustable in length, and
6. Anchor means 19 to enable the formwork clamp to be anchored to the ground.

Referring now in greater detail to the formwork clamp, the lower elongate support member 10 comprises a steel box section having a length of about 1 m, and a width and height of about 20 mm. The box section is entirely hollow. The head portion 11 of the box section contains a mounting bracket 20 which is a rectangular steel plate welded to the front of the box section and which contains an opening through which a self drilling screw can pass to attach the lower elongate support member 10 to a lower portion of the formwork 18 this being illustrated particularly in FIG. 1.

Figure 9:
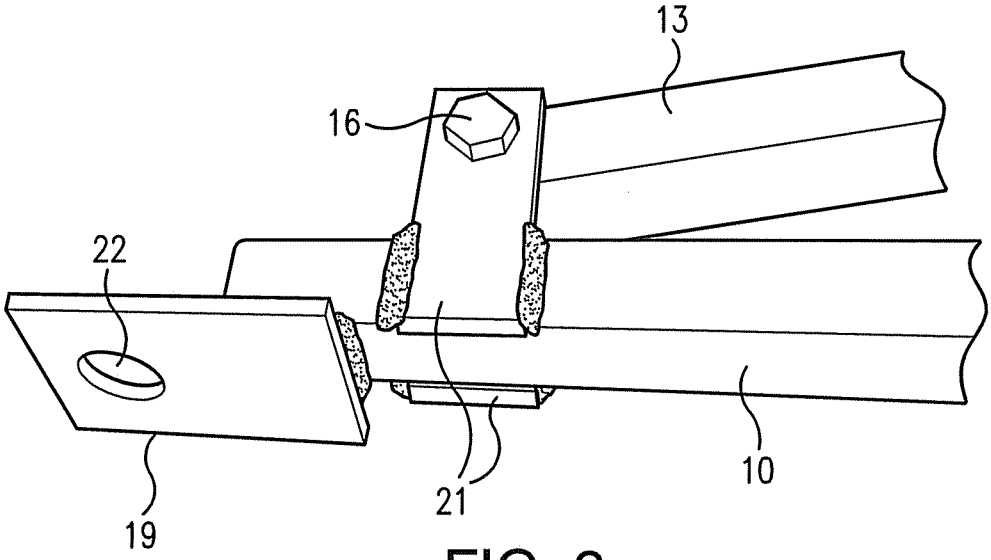
FIG. 9. Illustrates a close up view of the "tail end" of the formwork clamp.

The rear end of the box section comprises a pair of short rectangular upstanding bracket plates 21 (see particularly FIG. 9), and an alligned opening extending through the upper end of each bracket plates 21 to contain a pivot pin 16. The bracket plates 21 are welded to each opposed side wall of the lower elongate support member 10.

Referring again to FIG. 9, behind bracket plates 21 and welded to the bottom wall of lower elongate support member 10 is an anchor means 19 in the form of a rectangular steel plate containing an opening 22 through which an anchor pin 23 (see for instance FIG. 3 as an example) can be hammered to hold the entire clamp in place.

Figure 2:
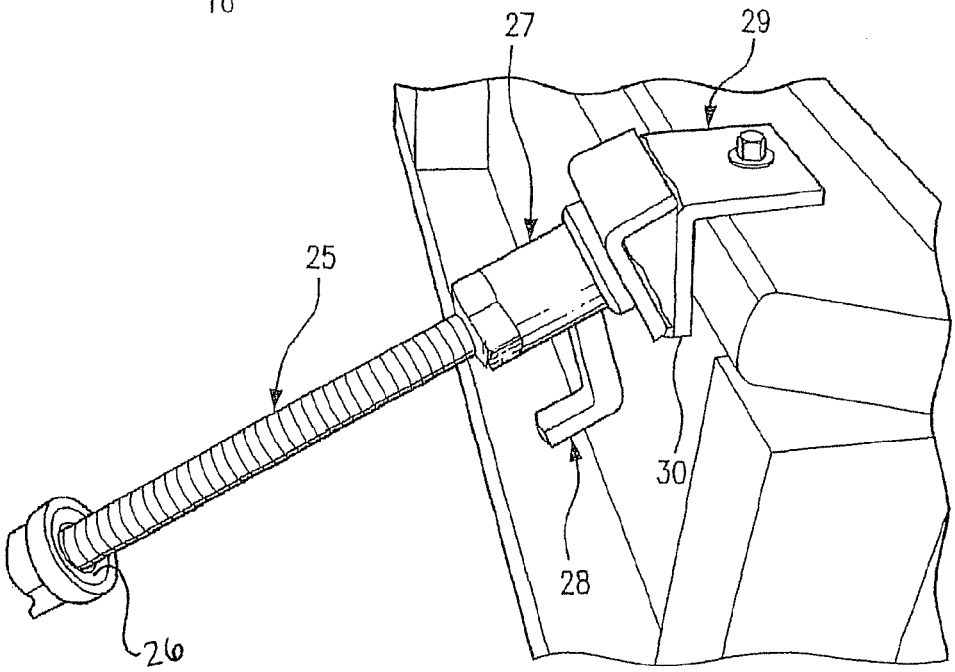
FIG. 2. Illustrates a close up view of the front "working" end of the upper part of the formwork clamp.

The upper elongate support member 13 is length adjustable in a telescopic manner and is made of two main parts being a rear housing 24 which is hollow and has an open front and a steel threaded rod 25 which can extend into and out of the housing to adjust the length of elongate support member 13. The front of housing 24 contains a threaded nut 26 (see FIG. 2) which threadingly engages with the threaded rod 25. The rear housing is made of box section similar or identical to the lower elongate support member 10 but shorter in length to accommodate the length of the threaded rod 25.

The front of rod 25 contains a turn member 27 (best illustrated in FIG. 2 and FIG. 8) which is welded to the front of rod 25. Turn member 26 comprises a larger diameter steel body. An L-shaped lug 28 extends from the steel body and provides a purchase to enable a claw hammer or a steel rod or something similar to engage with the lug to assist in rotation of the turn member and therefore the threaded rod.

Figure 8:
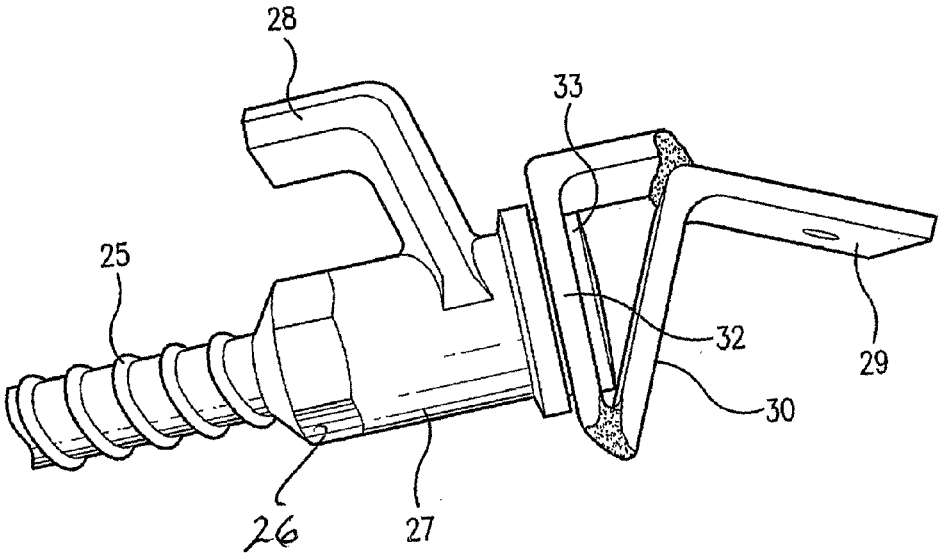
FIG. 8. illustrates a close up view of the turn member and the mounting member on the front of the upper arm member of the formwork clamp.

The turn member is rotatably attached to the mounting member 17 this being perhaps best illustrated in FIG. 8. Mounting member 17 comprises a bent steel plate which is bent into a forward substantially L-shaped configuration defining a top mounting face 29 which mounts to the top wall of formwork 18 (see for instance FIG. 2), and a side mounting face 30 which abut against the side wall of formwork 18 (see again FIG. 2). The top mounting face 29 contains an opening 31 (see FIG. 4) through which a self drilling screw can pass to lock the top mounting face 29 (and therefore the mounting member 17) to an upper part of the formwork 18.

A rear part 32 of mounting member 17 (see FIG. 8) is rotatably attached to the front of the upper elongate support member 13. Specifically, the threaded rod 25 extends entirely through turn member 27 (which is hollow) and the front end of threaded rod 25 passes through an opening (not illustrated) in the rear part 32 of mounting member 17. The opening is larger than the threaded rod such that the threads do not engage with the opening thereby allowing relative rotation between the threaded rod and the mounting member 17. Once the end of the threaded rod has passed through the opening in rear part 32, a washer 33 is welded to the front of the threaded rod which now traps the mounting member 17 to the front of the threaded rod and immediately in front of the turn member 27 in a rotatable manner. This means that as the threaded rod is rotated to adjust the length of the upper elongate member 13, the mounting member does not rotate (which it should not do because it is screwed to the formwork 18).

Figure 4:
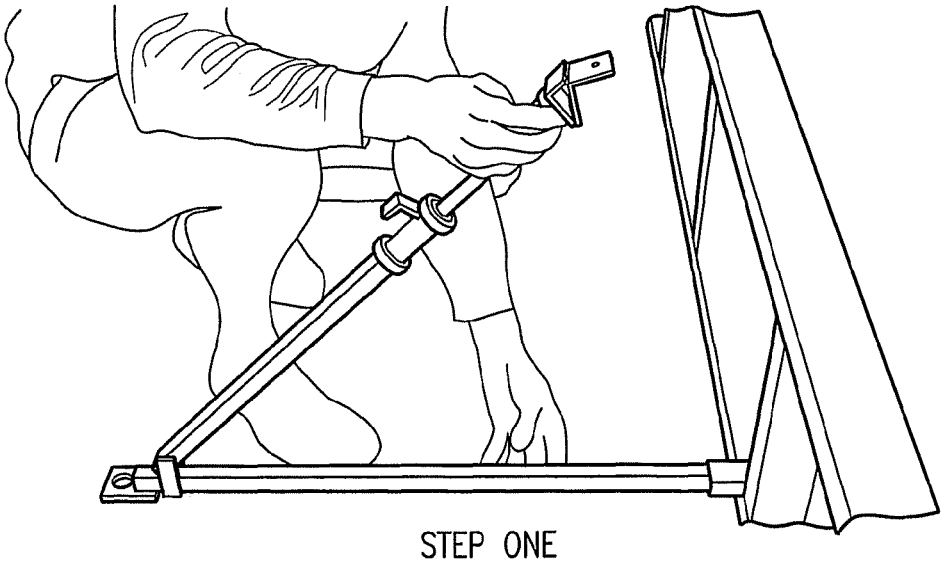
FIG. 4. Illustrates the first step in the use of the formwork clamp.
Figure 5:
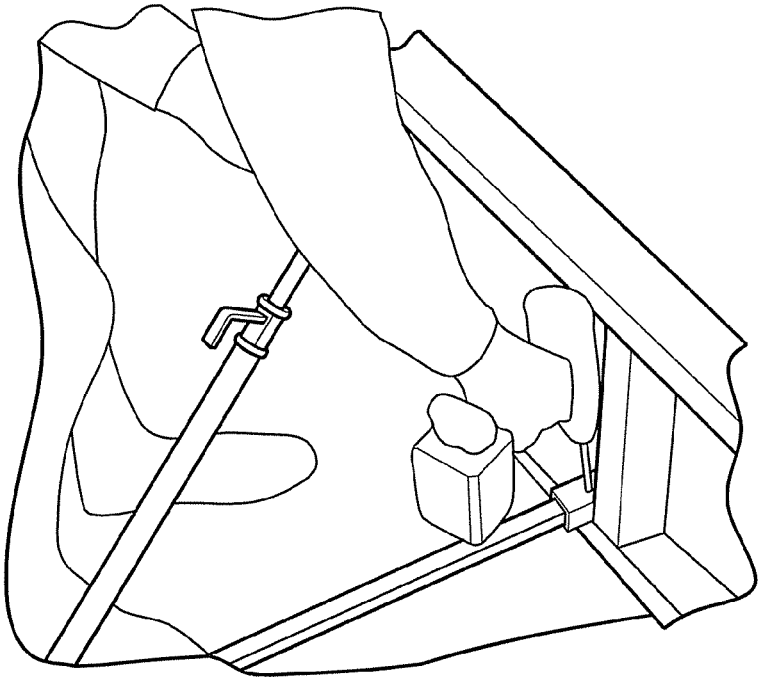
FIG. 5. Illustrates the second step in the use of the formwork clamp.
Figure 6:
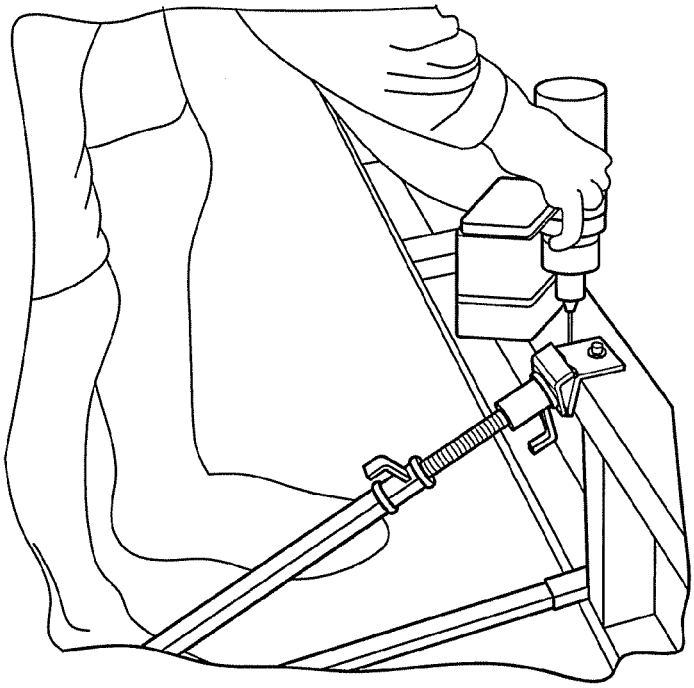
FIG. 6. Illustrates the third step in the use of the formwork clamp.
Figure 7:
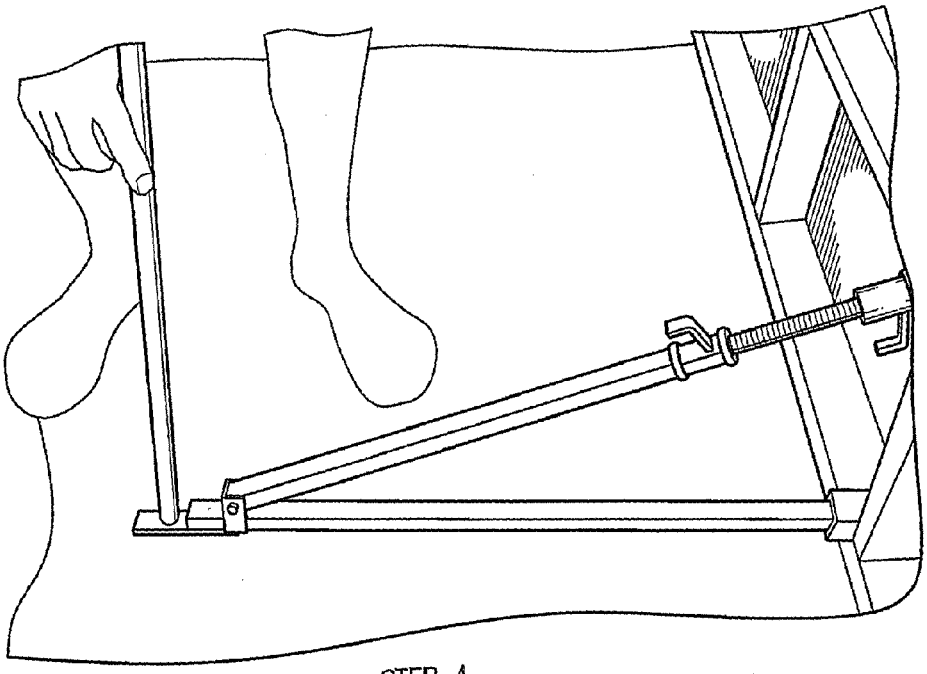
FIG. 7. Illustrates the fourth step in the use of the formwork clamp.

The attachment of a formwork clamp is illustrated progressively in FIGS. 4-7. In FIG. 4, there is illustrated the first step which is to position the formwork clamp next to the formwork 18. FIG. 5 illustrates the second step which is to screw the front end of the lower elongate support member 10 to a lower part of the formwork using a self drilling screw. FIG. 6 illustrates the third step which is to screw the front end (mounting member 17) of the upper elongate support member 13 to the top of the formwork 18. If necessary, the rod can be rotated to provide the correct length. FIG. 7 illustrates the fourth step which is to hammer a steel anchor pin 23 through the opening in the anchor means 19.

The threaded rod can then be rotated either way to ensure that the formwork panel is exactly vertical.

These formwork clamps can be spaced along the outside of the formwork at suitable spacings (typically between 1.5-1.8 m). It is estimated that between 40-60 formwork clamps will be required for an average house slab.

Any concrete that may slop onto the threaded rod can be cleaned simply by winding the threaded rod past nut 26.

The formwork clamp is very strong and very hardy and has two easy fastening points to the formwork and one pin to anchor to a ground support. The mounting means 17 has a swivel adjustment to remain at the right angle when in use. The formwork clamp can fold together when not in use to reduce the space. The upper elongate member can be raised from the lower elongate member by a distance of between 20-60 cm to accommodate different heights of formwork.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

Any embodiment of the invention is meant to be illustrative only and is not meant to be limiting to the invention. Therefore, it should be appreciated that various other changes and modifications can be made to any embodiment described without departing from the spirit and scope of the invention.

What is claimed is:

1. A formwork clamp comprising:

a lower elongate support member having a head portion and a tail portion, the head portion adapted for attachment to a lower portion of formwork, the lower member extending substantially parallel to the ground surface in use, the lower elongate support member of fixed length, an upper elongate support member having a head portion for attachment to an upper portion of formwork and a tail portion, said upper elongate support member being adjustable in length and comprises a rear hollow housing having an open front and a threaded rod which is able to extend into and from the open front end of the housing, said housing comprising a thread to threadingly engage with the threaded rod, a mounting member attached to or forming part of the head portion of the upper elongate support member, the mounting member being attachable to an upper portion of the formwork, the lower elongate support member and the upper elongate support member being pivotally attached relative to each other at the respective tail portions and movable relative to each other between a collapsed position where the lower elongate member is more towards or against the upper elongate member, and an extended use position where the head portion and mounting member of the upper elongate member are spaced from the lower elongate member, and a substantially planar anchor means extending rearwardly of the tail portion of the upper elongate support member and attached rigidly to the lower elongate support member, to enable the formwork clamp to be anchored to the ground behind the tail portion of the upper elongate member, and a turn member attached to the front of the threaded rod and fixed to the threaded rod such that to adjust the length of the upper elongated support member the turn member turns with the threaded rod while the rear hollow housing and mounting member remains stationary.

2. The clamp as claimed in claim 1, wherein the tail portion of the upper elongate member is hingedly connected to the tail portion of the lower elongate member.

3. The clamp as claimed in claim 1, wherein the upper elongate support member and the lower elongate support member are hingedly connected to each other and are able to hinge between a collapsed position where the upper elongate support member and the lower elongate support member are closely proximate to each other, and an extended use position where the upper elongate member and the lower elongate member are substantially V shaped and define an angle of between 30-70° relative to each other.

4. The clamp as claimed in claim 1, wherein the head portion of the lower elongate member comprises a plate containing an opening through which a fastener can pass to fasten the plate to the formwork.

5. The clamp as claimed in claim 1, wherein the thread on the housing comprises a nut which is attached to the open front of the housing.

6. The clamp as claimed in claim 1, wherein the turn member contains an L-shaped lug to enable a tool to engage with the turn member to assist in rotating the turn member.

7. The clamp as claimed in claim 1, wherein the mounting member on the upper elongate member comprises a top mounting face formed with an opening through which a fastener can pass to fasten the top mounting face to the top of the formwork.

8. The clamp as claimed in claim 7, comprising a substantially L-shaped portion, one leg of the L-shaped portion comprising the top mounting face and the other leg of the L-shaped portion comprising a side mounting face.

9. The clamp as claimed in claim 1, wherein the mounting member can swivel on the end of the threaded rod of the upper elongate support member.

10. The clamp as claimed in claim 1, wherein the mounting member is positioned in front of the turn member.

* * * * *